US006047475A

United States Patent [19]

Tyrrell et al.

[11] Patent Number: 6,047,475

[45] Date of Patent: Apr. 11, 2000

[54] MOUNTING FOR A CONSTRUCTION SHEAR

[75] Inventors: Daniel E. Tyrrell, Ravenna; John Andrew Higgins, Perry, both of Ohio

[73] Assignee: Nippon Pneumatic Mfg. Co. Ltd., Osaka, Japan

[21] Appl. No.: 09/030,973

[22] Filed: Feb. 26, 1998

[51] Int. Cl.[7] ..... B25F 3/00

[52] U.S. Cl. ..... 30/134; 241/101.73

[58] Field of Search ..... 30/134; 241/101.73; 37/403, 406, 408; 83/928, 609, 258, 131

[56] References Cited

U.S. PATENT DOCUMENTS

| | | | |
|---|---|---|---|
| 3,294,131 | 12/1966 | Larson | 30/134 |
| 3,915,501 | 10/1975 | Cobb et al. | 37/403 |
| 4,199,033 | 4/1980 | Van Gundy, Jr. | 37/403 |
| 4,293,269 | 10/1981 | Zook | 37/403 |
| 4,669,187 | 6/1987 | Pardoe | 30/134 |
| 4,670,983 | 6/1987 | Ramun et al. | 30/134 |
| 4,697,509 | 10/1987 | LaBounty | 30/134 |
| 4,719,975 | 1/1988 | LaBounty | 173/46 |
| 4,776,093 | 10/1988 | Gross | 30/134 |
| 4,961,543 | 10/1990 | Sakato et al. | 241/101.73 |
| 5,054,958 | 10/1991 | Strunk | 241/101.73 |
| 5,065,514 | 11/1991 | Gross | 30/134 |
| 5,145,313 | 9/1992 | Weyer | 37/468 |
| 5,230,151 | 7/1993 | Kunzman et al. | 30/134 |
| 5,384,962 | 1/1995 | Pemberton | 83/609 |
| 5,441,090 | 8/1995 | Hill et al. | 83/928 |
| 5,471,747 | 12/1995 | Morikawa et al. | 83/928 |
| 5,484,250 | 1/1996 | Gilmore, Jr. et al. | 37/468 |
| 5,487,230 | 1/1996 | Weyer | 37/468 |
| 5,692,325 | 12/1997 | Kuzutani | 37/406 |

OTHER PUBLICATIONS

Mechanical Engineering Design, Joseph E. Shigley et al, McGraw–Hill Book Co., ISBN–0–07–056888–X, 1983.

*Primary Examiner*—Rinaldi I. Rada
*Assistant Examiner*—Melissa L. Hall
*Attorney, Agent, or Firm*—Vickers, Daniels & Young

[57] ABSTRACT

A demolition shear is attachable to a mobile machine by one of two brackets. The brackets engage, alternatively, two of three pairs of mounting holes on the shear so the shear can be mounted at its proximal end to the stick or at its side to the boom of the machine.

12 Claims, 3 Drawing Sheets

MOUNTING FOR A CONSTRUCTION SHEAR

BACKGROUND OF THE INVENTION

The present invention relates to heavy duty shears of the type mountable on mobile construction equipment such as excavating machines and, more particularly, to an improved connection of the shear to the construction equipment.

Heavy duty shears of the type to which the present invention is directed are well known and widely used in demolition, scrap handling, and other areas where large metallic pieces must be reduced in size. Bridge demolition sites, building demolition sites and scrap yards often contain assemblies of I-beams, iron channels, metallic pipes, and other structural components which must be reduced in size and moved. Demolition shears are useful in reducing the size of scrap. It is often necessary to move the shears within a site. Therefore, the shears are often mounted on heavy equipment such as an excavator. This allows the operator to manipulate the shear from the cab of the excavator to pick-up pieces of scrap, reduce them in size and pile them. It also allows the operator to move the shear and the mobile equipment within the site.

Many modem excavating machines are hydraulically operated, supported on tracks on an under carrier and have a rotatable cab mounted on the under carriage. The operational portion of the excavator consists of a rigid boom connected at one end to the rotating portion of the excavator. Hydraulic cylinders control the boom and allow the operator to pivot the boom in a vertical plane. A rigid stick is fixed to the end of the boom away from the cab. The stick also can pivot about the end of the boom in a vertical plane. It is controlled by one or more hydraulic cylinders under the control of the operator. When used as an excavator, a bucket is mounted at the end of the stick with the opening and teeth of the bucket facing the operator. The bucket is also rotatable in a vertical plane by means of one or more hydraulic cylinders under the control of the operator. This arrangement of a boom, a stick and a utensil such as an excavating bucket has proven advantageous and is used in many excavators. It allows the operator flexibility, a long reach and good visibility of the utensil as it works.

The capacity of an excavator to lift or carry a load is determined by a number of factors. One factor is the distance of the load from the center of gravity of the excavator. Thus, an excavator can lift or carry a larger load held close to its center of gravity when compared to lifting the load at a greater distance from the center of gravity. For example, an excavator may be able to lift a particular I-beam located 10 feet from its track without a problem. However, if the same I-beam is 30 feet from the track the excavator may start to tip if it attempts to lift that I-beam with an extended boom and stick.

Demolition shears are typically constructed from steel, are very heavy and very robust. Therefore, the mounting arrangement for these shears are also heavy and robust. They are usually structured with a particular mounting orientation in mind and have the strength to support the structure in that orientation.

While the above-described shear and mounting arrangement provide a great deal of flexibility to operators, more flexibility is always desirable. The more different ways a utensil can be used, the more utility it will have to the end user.

SUMMARY OF THE INVENTION

In accordance with the present invention, an improved mounting structure is provided for a heavy duty shear which allows the shear to be advantageously mounted at the end of a stick of an excavating machine or alternatively at the end of the boom of an excavating machine in place of the stick. More particularly, two sets of apertures are provided on the body of the shear and two mounting brackets provided to selectively engage these apertures. One mounting bracket is adapted to mount the shear on the end of the stick of the excavator, while the other mounting bracket is adapted to advantageously mount the shear on the end of the boom of the excavator.

It is the primary object of the present invention to provide a demolition shear which can be advantageously mounted in different configurations on an excavating machine.

It is another object of the present invention to provide a demolition shear which can be mounted on different excavating machines without the necessity of modifying the structure of the shear itself.

It is yet another object of the present invention to provide a demolition shear which can be moved from one piece of construction equipment to another without the need to modify the structure of the shear itself to accommodate the new construction equipment.

It is still another object of the present invention to provide a demolition shear which can be manufactured inexpensively in a single configuration yet easily modified to be mounted upon construction equipment having different characteristics.

It is still another object of the present invention to provide a demolition shear which can be changed in configuration and mounting parameters by simply substituting a different mounting bracket adapted to mate with the new piece of equipment.

It is another object of the present invention to an operator to carry a larger shear at the end of the boom thereby sacrificing reach in favor of capacity; or, a smaller shear at the end of the stick, thereby sacrificing capacity in favor of reach.

It is still another object of the present invention to allow an operator to mount a larger shear on a smaller excavator by mounting the shear on the boom and thus limiting its reach.

It is another object of the present invention to provide a demolition shear which allows an operator maximum flexibility and proper positioning in both the stick mount and boom mount configurations.

It is still another object of the present invention to provide a demolition shear giving an operator maximum reach, maximum tool visibility and versatility of application.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF THE PREFERRED EMBODIMENT

Figure 1:
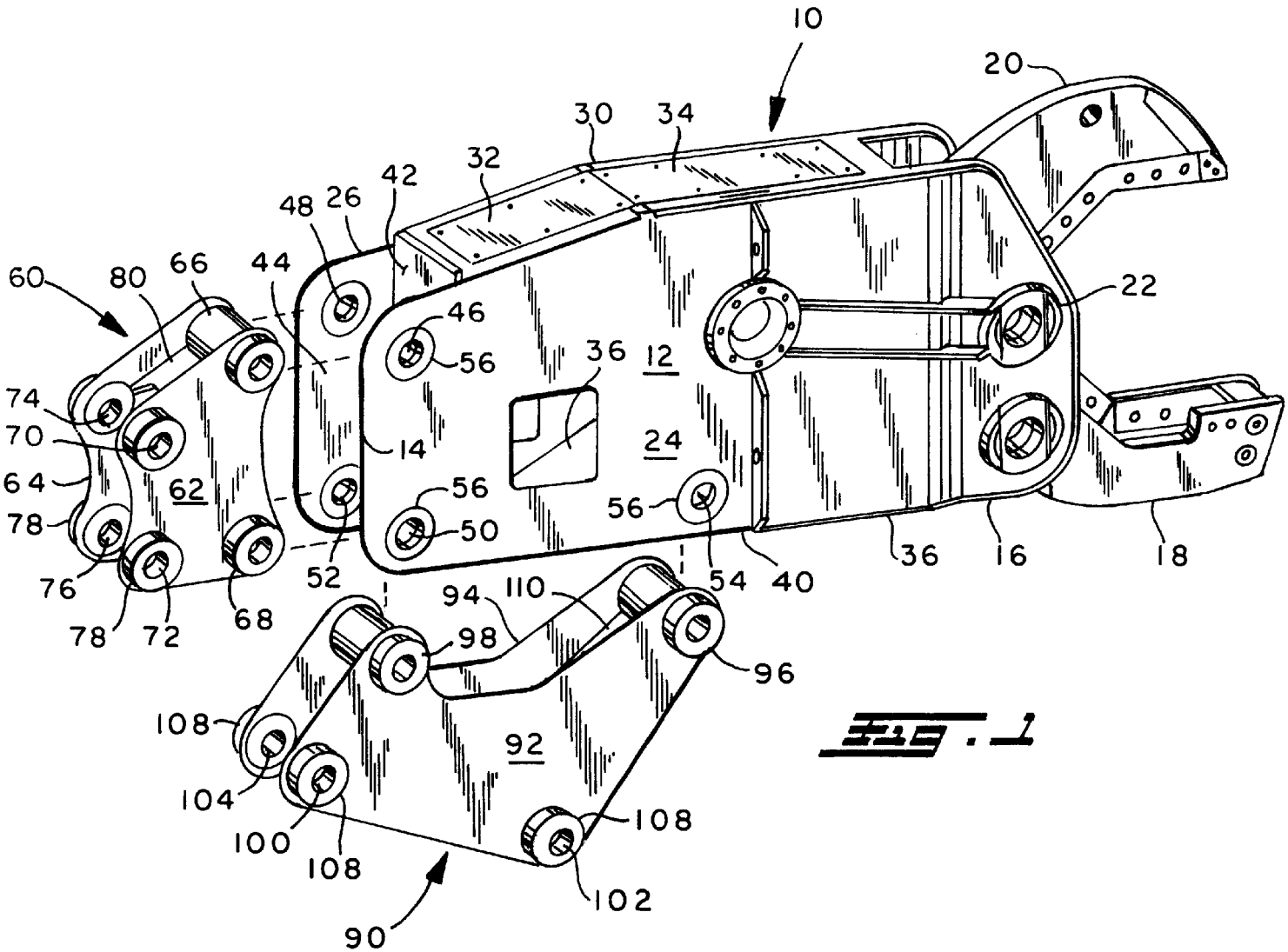
FIG. 1 is a perspective view of a heavy duty sheer and two mounting brackets for that heavy duty shear in accordance with the present invention.

Referring now in greater detail to the drawings wherein the showings are for the purposes of illustrating a preferred embodiment of the invention only and not for the purpose of limiting the invention, FIG. 1 illustrates a demolition shear 10 comprised of a boxlike body 12 having a proximal end 14 and a distal end 16. A fixed jaw 18 and a movable jaw 20 extend from the distal end 16 of the body 12. The movable jaw 20 is rotatable about a pin 22 and is driven by a hydraulic cylinder contained within the body 12. When rotated, the movable jaw 20 engages the fixed jaw 18 and shears what is between them. Many such heavy duty shears have been described in issued U.S. patents such as U.S. Pat. No. 5,230,151 to Kunzman, et al. The operation of the shear is fully described therein and will not be repeated here.

The shear body 12 is generally box shaped with four side walls, a proximal end 14 and a distal end 16. A right side wall 24 is seen in FIG. 1. The left side wall 26 is generally the mirror image of the right side wall 24. The right side wall 24 and the left side wall 26 are constructed from robust steel plate as they are structural members supporting the shear. The top side wall 30 extends between the right side wall 24 and the left side wall 26. The top side wall 30 is provided with removable access plates 32, 34 which allow an operator to reach the cylinder and other moving parts of the shear 10.

A bottom side wall 36 connects the right side wall 24 and left side wall 26. The bottom side wall 36 is somewhat irregular in shape. The right side wall 24 and the left side wall 26 extend beyond the bottom side wall 36 forming a pocket 40 between the right and left side walls 24, 26 in about the middle of the shear body 12. A proximal end wall 42 is generally flat and closes the proximal end 14. Both the right side wall 24 and the left side wall 26 extend an appreciable distance beyond the proximal end wall 42 creating a proximal pocket 44. A top proximal hole 46 is provided near the top proximal comer of the right side wall 24 outside the proximal wall 42. An identical top proximal hole 48 is provided in the left side wall 26. The right side wall top proximal hole 46 and the left side wall top proximal hole 48 are aligned so that a straight pin (not shown in FIG. 1) passing through right side top proximal hole 46 will also pass through the left side top proximal hole 48. A bottom proximal hole 50 is provided in the bottom proximal corner of the right side wall 24. An identical bottom proximal hole 52 is provided in the bottom proximal comer of the left side wall 26. The right side wall bottom proximal hole 50 and the left side wall bottom proximal hole 52 are aligned so that a pin (not shown in FIG. 1) passing through the right side wall hole 50 will also pass through the left side wall hole 52. A bottom central hole 54 is provided near the bottom edge of the right side wall 24 about midway between proximal end 14 and distal end 16 of the shear body 12. An identical bottom central hole 54 is provided in the left side wall 26. The bottom central holes 54 are positioned in the side walls 24, 26 in the area forming the side pocket 40 such that a pin (not shown in FIG. 1) passing through the bottom central holes 54 will pass through both holes and through the pocket 40 without entering the enclosed portion of the body 12.

All of the proximal holes 46, 48, 50, 52 and the central holes 54 are reinforced with annular plates or bosses 56. All of the proximal holes 46, 48, 50, 52 and the central holes 54 are in portions of the side walls 24, 26 facing either the proximal pocket 44 or the side pocket 40 and not opening into the closed portion of the body 12.

A proximal mounting bracket 60 is shown disassembled from the demolition shear 10 in FIG. 1. The proximal mounting bracket 60 comprises a right side plate 62 and a left side plate 64. A top proximal tube 66 passes between the right side plate 62 on the left side plate 64. The top proximal tube 66 extends a short distance beyond the outer facing sides of the right side plate 62 and the left side plate 64. A bottom proximal tube 68 also passes between the right side plate 62 and the left side plate 64 and extends a short distance outwardly beyond the plates. The bottom proximal tube 68 is parallel to the top proximal tube 66 and the two proximal tubes are of equal length.

The right side plate 62 is generally trapezoidal in shape. Holes 70, 72, 74, 76 are provided in the comers of the right side plate 62 and left side plate 64 remote from the shear 10. Bosses 78 are fixed to the right side plate and left side plate 62, 64 reinforcing the side plates around the holes 70, 72, 74, and 76. Gussets 80 comprising flat steel plates are welded between the right side plate 62 and the left side plate 64 strengthening the proximal mounting bracket 60.

Figure 2:
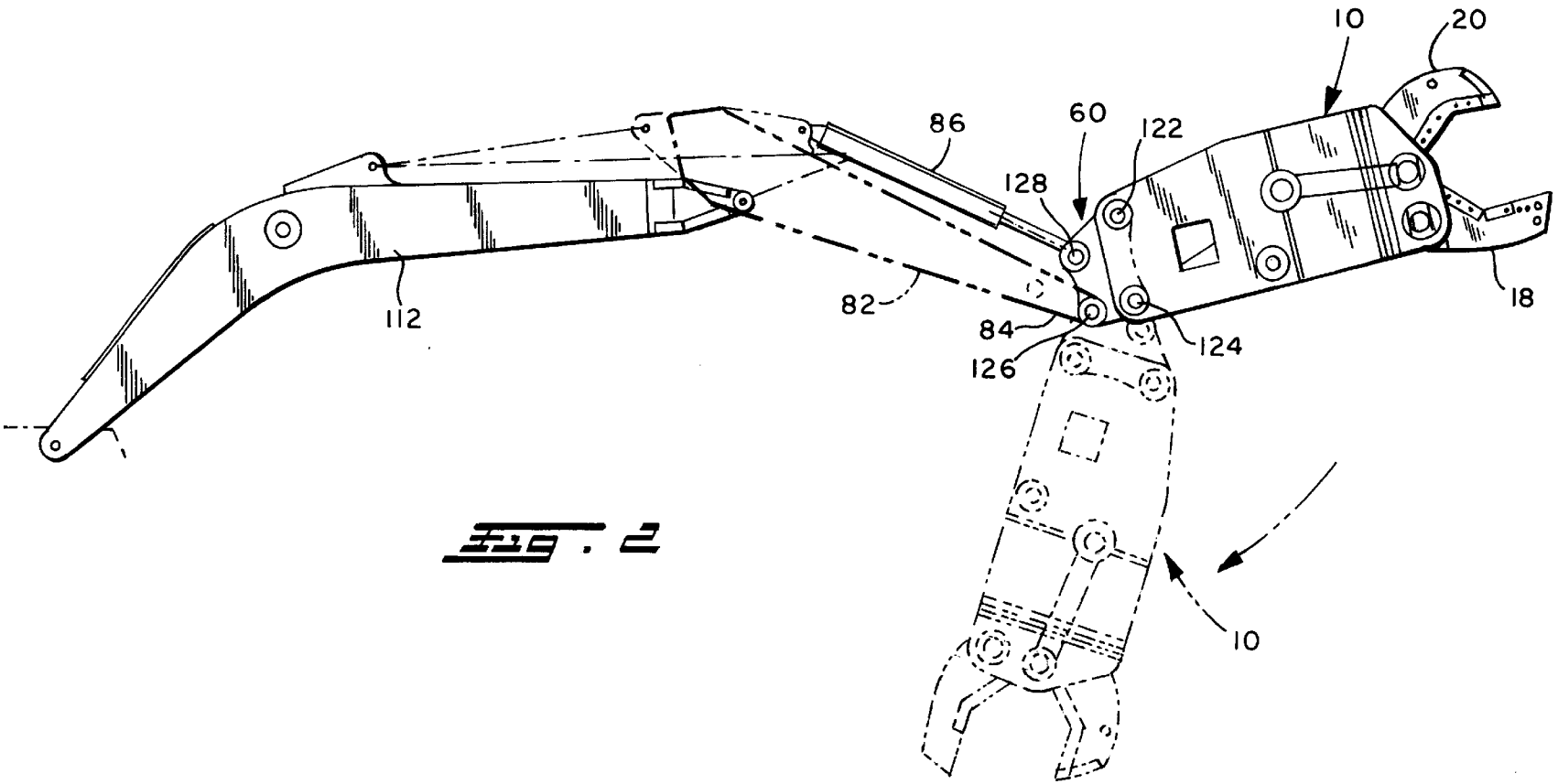
FIG. 2 is a side elevation of the boom and stick of an excavator with the shear of FIG. 1 mounted on the end of the stick with one of the brackets seen in FIG. 1; and, FIG. 3 is a side elevation of the boom of an excavator with the shear of FIG. 1 mounted directly on the boom with the other of the brackets seen in FIG. 1.

As can be seen in FIG. 2, the proximal mounting bracket is used to fix the heavy duty shear 10 to the stick 82 of an excavator. The proximal mounting bracket 60 is positioned in the proximal pocket 44 with the top proximal tube 66 aligned with the two top proximal holes 46, 48. A pin 122 is passed through the tube and holes and is fixed in place. The bottom proximal tube 68 is aligned with the bottom proximal holes 50, 52 and a pin 124 is passed through the holes and tube and fixed in place. The stick 82 of the excavator is provided with a hole near its distal end 84. The stick distal end 84 is positioned between the holes 72, 76 in the bracket 60 and a pin 126 is passed through the holes and fixed in place. Similarly, the distal end of the cylinder 86 connecting the stick to the shear 10 is fixed with a pin 128 through holes 70, 74 in the bracket 60. The holes and tubes in the bracket 60 are spaced so that for a particular excavator, the shear 10 is provided with the maximum range of motion. The shear 10 is shown in solid form at its fully extended positioned giving the excavator-shear combination its maximum reach. The shear 10 is shown in phantom with the cylinder 86 fully extended bringing the shear 10 into a downwardly and slightly inwardly orientation with respect to the stick 82. This allows an operator of the excavator to position the stick 82 so that the opening between jaws 20, 18 is facing the operator for maximum visibility and flexibility in cutting.

Advantageously, the geometry of the holes and tubes in the proximal mounting bracket 60 can be altered to accommodate many different excavators. A manufacturer can therefore manufacture one standard shear 10 and modify mounting brackets 60, 90 to accommodate different excavators. Economy in manufacturing is achieved. An end user who buys a new excavator can keep his shear and simply buy new mounting brackets 60, 90 to accommodate the new excavator.

Figure 3:
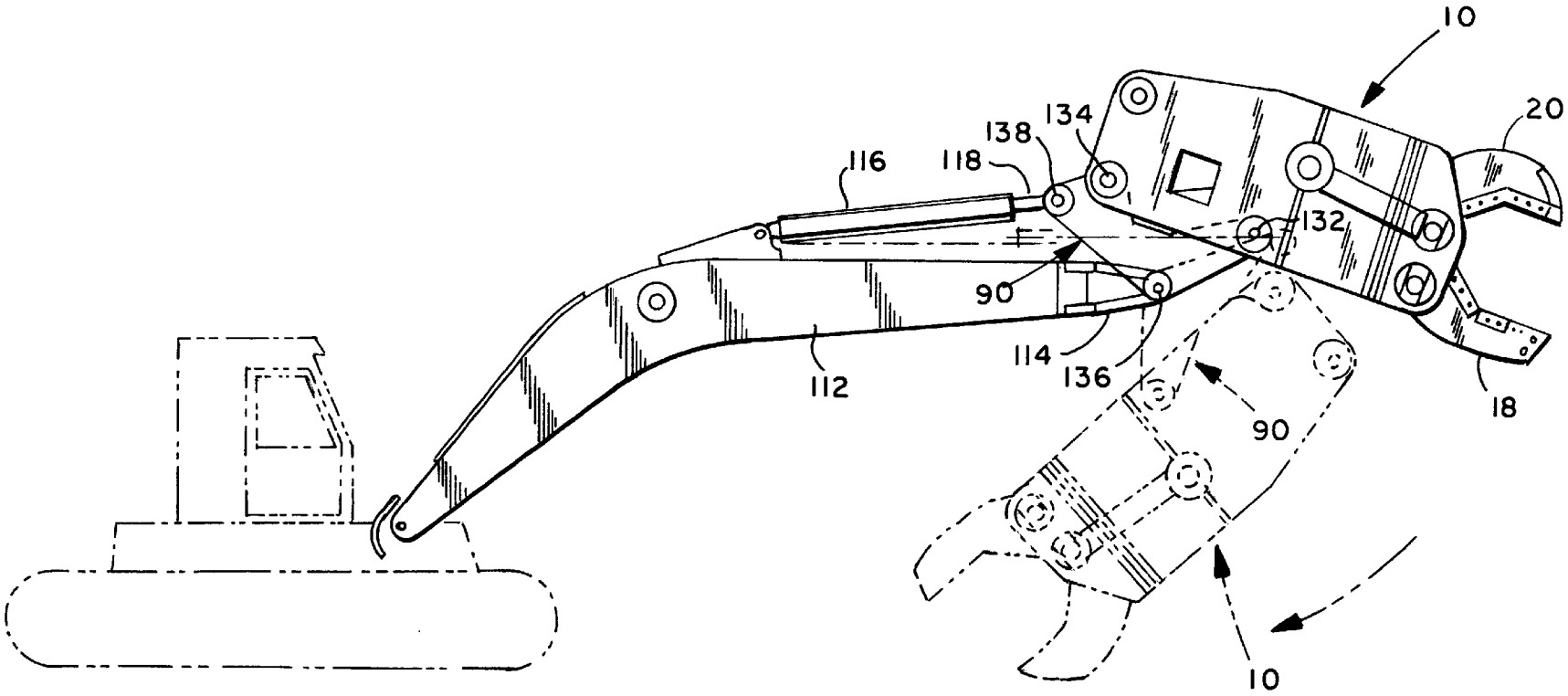

Referring again to FIG. 1, a side mounting bracket 90 is illustrated. The side mounting bracket 90 has a right side plate 92, a left side plate 94, a bottom central tube 96, a bottom proximal tube 98, and four holes 100, 102, 104, (one of the holes is not shown). The holes are reinforced with bosses 108 and a gusset 110 stiffens the side mounting bracket 90. The side mounting bracket 90 is used as illustrated in FIG. 3. The bottom central tube 96 is received in the side pocket 40. A pin 132 passes through the bottom central holes 54 and bottom central tube 96. The pin is fixed in place. Similarly, the bottom proximal tube 98 is received in the proximal pocket 44 and a pin 134 passes through the bottom proximal holes 50, 52 and the bottom proximal tube 98 fixing the bracket 90 to the shear body 12. A pin 136 is passed through the hole 102 in the right side plate 92 of bracket 90, a passage in the end of the boom 112 and the left side plate 94, affixing the bracket 90 to the distal end 114 of the boom 112. A pin 138 passes through holes 100 and 104 in the bracket 90 and also through the end of the rod 118 of a cylinder 116 fixed to the boom 112. The shear is thereby fixed to the boom 112 and rotatable about the distal end 114 of the boom 112 by means of the cylinder 116. As best can be seen in FIG. 3, the use of the side bracket allows the shear 10 to be rotated from a position where the jaw opening faces away from the boom 112 and excavator operator to a position with a jaw opening that is facing toward the excavator and operator. In the boom mount seen in FIG. 3, the jaws can be turned to be facing the operator by action of the boom connected cylinder 116 only. This is necessary as there is no stick to be manipulated. When the shear 10 is mounted on the stick 82 as seen in FIG. 2, an operator can rotate the stick 82 on the boom 112 as well as rotating the shear 10 on the stick 82. Thus, the operator can achieve the same positioning by moving two cylinders rather than one.

As with the proximal mounting bracket 60, the side mounting bracket 90 can be changed to accommodate different models of excavators. The tubes 96 and 98 are left in the same place but the geometry of the plates 92, 94 and the placement of the holes 100, 102, 104 are changed to accommodate different excavator configurations. Again, should an end user buy a new excavator or have more than one model excavator, he can use the same shear on multiple units having different geometries by simply substituting different side mounting brackets.

The pins (seen in FIGS. 2 and 3) used to mount the brackets 60, 90 on the shear body 12 are of the same size and length. Thus, extra pins need not be kept with the brackets. Four pins will suffice to mount either bracket on the body 12 and an excavator. As only one bracket is used at a time, only three pairs of mounting holes on the shear body 12 are required. The bottom proximal holes 50, 52 are used with both the side mounting bracket 90 and the proximal mounting bracket 60. This minimizes the size of the shear 10 and saves manufacturing costs.

For some excavators, it may be possible to mount the shear 10 directly on the stick 82 or boom 112 by use of the holes 46, 48, 50, 52, 54, thus dispensing with the use of the brackets. However, in most installations, the brackets will ease the mounting process and improve the geometry of use of the shear 10.

The invention has been described with reference to a preferred embodiment. Obviously, modifications and alterations will occur to others upon the reading and understanding of this specification. It is intended to include all such modifications insofar as they come within the scope of the appended claims or the equivalents thereof.

Having thus described the invention, it is so claimed:

1. A shear for attachment to a mobile machine having a boom having an end, and a stick having an end, said shear comprising;

a housing having a proximal end, a distal end, a right side wall, a left side wall generally parallel to said right side wall, a bottom side and a top side;

at least two jaws mounted on said housing near said distal end, one said jaw being adapted for movement toward and away from the other jaw;

said right side wall having a first hole near said proximal end and top side, a second hole near said proximal end and bottom side, and a third hole spaced from said proximal end near said bottom side;

said left side wall having a first hole near siad proximal end and top side aligned with said first hole of said right side wall, a second hole near said proximal end and said bottom side aligned with said second hole of said right wall, and a third hole spaced from said proximal end near said bottom said aligned with said third hole of said right wall;

said first second holes of said right side wall and said first and second holes of said left side wall defining a proximal mounting plane, said second and third holes of said right side wall and said second and third holes of said left side wall defining a side mounting plane, and said proximal mounting plane and said side mounting plane being generally perpendicular to one another;

said first and second holes defining a proximal mounting arrangement, and said second and said third holes defining a side mounting arrangement;

said shear being mounted to said mobile machine selectively at said stick end or said boom end using one of said proximal and side mounting arrangements;

wherein said housing of said shear has a proximal end wall extending between said right side wall and said left side wall, said right side wall and said left side wall extend beyond said proximal end wall defining a proximal end pocket, and said first and second holes are in the portions of said right side wall and said left side wall extending beyond said proximal end wall defining said proximal end pocket;

wherein said shear housing has a bottom side wall extending between said right side wall and said left side wall, said right side wall and said left side wall extend beyond said bottom side wall defining a side pocket, and side third holes are in the portions of said right side wall and said left side wall defining said side pocket; and wherein said shear housing comprises a substantially closed portion and said first, second and third holes are in portions of said right side wall and said left side wall removed from said closed portion.

2. The shear of claim 1, further comprising a proximal mounting bracket engaging said first holes, said second holes and said stick end of said mobile machine.

3. The shear of claim 2, wherein said proximal mounting bracket comprises at least two parallel plates connected to one another, means for engaging said shear and means for engaging said mobile machine.

4. The shear of claim 3, wherein said bracket means for engaging said shear comprises tubes extending between said parallel plates adapted to receive pins.

5. The shear of claim 4, wherein said means for engaging said mobile machine comprises two pairs of aligned holes one of each said pair in each of said parallel plates, said pairs of holes adapted to receive said pins.

6. A shear for attachment to a mobile machine having a boom having an end, and a stick having an end, said shear comprising:

a housing having a proximal end, a distal end, a right side wall, a left side wall generally parallel to said right side wall, a bottom side and a top side;

at least two jaws mounted on said housing near said distal end, one said jaw being adapted for movement toward and away from the other said jaw;

said right side wall having a first hole near said proximal end and top side, a second hole near said proximal end and bottom side, and a third hole spaced from said proximal end near said bottom side;

said left side wall having a first hole near said proximal end and top side aligned with said first hole of said right side wall, a second hole near said proximal end and said bottom side aligned with said second hole of said right side wall, and a third hole spaced from said proximal end near said bottom side aligned with said third hole of said right side wall;

said first and second holes defining a proximal mounting arrangement, and said second and said third holes defining a side mounting arrangement;

said shear being mounted to said mobile machine selectively at said stick end or said boom end using one of said proximal and side mounting arrangements, further comprising a side bracket engaging said second holes, said third holes and said boom end of said mobile machine;

wherein said housing of said shear has a proximal end wall extending between said right side wall and said left side wall, said right side wall and said left side wall extend beyond said proximal end wall defining a proximal end pocket, and said first and second holes are in the portions of said right side wall and said left side wall extending beyond said proximal end wall defining said proximal end pocket;

wherein said shear housing has a bottom side wall extending between said right side wall and said left side wall, said right side wall and said left side wall extend beyond said bottom side wall defining a side pocket, and said third holes are in the portions of said right side wall and said left side wall defining said side pocket; and wherein said shear housing comprises a substantially closed portion and said first, second and third holes are in portions of said right side wall and said left side wall removed from said closed portion.

7. The shear of claim 6, wherein said side bracket comprises at least two parallel plates connected to one another, means for engaging said shear and means for engaging said mobile machine.

8. The shear of claim 7, wherein said means for engaging said shear comprises tubes extending between said parallel plates adapted to receive pins.

9. The shear of claim 8, wherein said means for engaging said mobile machine comprises two pairs of aligned holes, one of each said pairs in each of said parallel plates, said pairs of holes receiving said pins.

10. A shear for attachment to a mobile machine support member comprising:

a fixed cutting jaw;

a movable cutting jaw adapted to engage said fixed cutting jaw;

a housing having a proximal end and a distal end supporting said fixed cutting jaw and said movable cutting jaw at said distal end, said housing having at least one side wall and a mounting means for connecting said housing to said mobile machine selectively at said proximal end or said side wall;

wherein said mounting means comprises apertures in said housing near said proximal end and said side wall and, wherein said mounting means comprises first, second and third pairs of apertures, said first and second pairs of apertures defining a proximal mounting arrangement to connect said housing to said mobile machine at said proximal end and said second and third pairs of apertures defining a side wall mounting arrangement to connect said housing to said mobile machine at said side wall;

said first and second pairs of apertures defining a proximal mounting plane, said second and third pairs of apertures defining a side mounting plane, said proximal mounting plane and said side mounting plane being generally perpendicular to one another.

11. The shear of claim 10, wherein said mounting means further comprises a first bracket having apertures engaging said housing apertures near said proximal end and said mobile machine.

12. The shear of claim 10, wherein said mounting means further comprises a bracket having apertures engaging said housing aperture near said sidewall and said mobile machine.

* * * * *